US008652274B2

(12) United States Patent
Kim et al.

(10) Patent No.: US 8,652,274 B2
(45) Date of Patent: Feb. 18, 2014

(54) COPPER ALLOY WITH HIGH STRENGTH AND HIGH CONDUCTIBILITY, AND METHOD FOR MANUFACTURING SAME

(75) Inventors: Dae Hyun Kim, Ulsan (KR); Dong Woo Lee, Incheon (KR); In Dal Kim, Anyang-si (KR); Sang Young Choi, Seoul (KR); Ji Hoon Lee, Ulsan (KR); Bo Min Jeon, Ulsan (KR)

(73) Assignee: Poonsgan Corporation, Seoul (KR)

( * ) Notice: Subject to any disclaimer, the term of this patent is extended or adjusted under 35 U.S.C. 154(b) by 0 days.

(21) Appl. No.: 13/580,954

(22) PCT Filed: Dec. 7, 2010

(86) PCT No.: PCT/KR2010/008698

§ 371 (c)(1),
(2), (4) Date: Aug. 23, 2012

(87) PCT Pub. No.: WO2011/105686

PCT Pub. Date: Sep. 1, 2011

(65) Prior Publication Data

US 2012/0312431 A1 Dec. 13, 2012

(30) Foreign Application Priority Data

Feb. 24, 2010 (KR) ..... 10-2010-0016516

(51) Int. Cl.
*C22C 9/02* (2006.01)
*C22F 1/08* (2006.01)

(52) U.S. Cl.
USPC ..... 148/433; 148/553; 148/554; 148/682; 420/470

(58) Field of Classification Search
USPC ..... 148/553, 554, 682, 433; 420/470
See application file for complete search history.

(56) References Cited

U.S. PATENT DOCUMENTS

| | | | |
|---|---|---|---|
| 4,822,560 | A | 4/1989 | Oyama et al. |
| 6,482,276 | B2 | 11/2002 | Hirai et al. |
| 2009/0003607 | A1 | 1/2009 | Aciicmez et al. |
| 2010/0203354 | A1 | 8/2010 | Mihara et al. |

FOREIGN PATENT DOCUMENTS

| | | | | |
|---|---|---|---|---|
| JP | 07-054079 | A | | 2/1995 |
| JP | 2001-181757 | A | | 7/2001 |
| JP | 2002038246 | A | * | 2/2002 |
| JP | 2003-089832 | A | | 3/2003 |
| JP | 2007126739 | A | * | 5/2007 |
| JP | 2008-081762 | A | | 4/2008 |
| JP | 2008-202144 | A | | 9/2008 |
| KR | 10-2009-0004626 | A | | 1/2009 |

* cited by examiner

*Primary Examiner* — Sikyin Ip
(74) *Attorney, Agent, or Firm* — Maschoff Brennan

(57) ABSTRACT

A copper alloy includes Si to facilitate deoxidation, and can be easily manufactured even when including elements such as Cr or Sn. The copper alloy has high conductivity and high workability without negatively affecting the tensile strength. The copper alloy contains 0.2 to 0.4 wt % of Cr, 0.05 to 0.15 wt % of Sn, 0.05 to 0.15 wt % of Zn, 0.01 to 0.30 wt % of Mg, 0.03 to 0.07 wt % of Si, with the remainder being Cu and inevitable impurities. A method for manufacturing the copper alloy includes obtaining a molten metal having the described composition; obtaining an ingot; heating the ingot at a temperature of 900-1000° C. to perform a hot rolling process; cold rolling; performing a first aging process at a temperature of 400-500° C. for 2 to 8 hours; cold rolling; and performing a second aging process at a temperature of 370-450° C. for 2 to 8 hours.

9 Claims, 3 Drawing Sheets

COPPER ALLOY WITH HIGH STRENGTH AND HIGH CONDUCTIBILITY, AND METHOD FOR MANUFACTURING SAME

CROSS-REFERENCE TO RELATED APPLICATIONS

This application is a 371 of international Application No. PCT/KR2010/008698, filed Dec. 7, 2010, titled HIGH-STRENGTH AND HIGHLY CONDUCTIVE COPPER ALLOY, AND METHOD FOR MANUFACTURING SAME, which claims priority to Korean Patent Application No 10-2010-0016516, filed Feb. 24, 2010, both of which are incorporated herein by reference in their entireties.

BACKGROUND ART

A copper base material having excellent electric and heat conductibility has been used as a semiconductor lead frame material or a terminal and connector material, widely. As a trend of fabrication of devices heads for high density integration, or fabrication of a smaller device, besides the electric and heat conductibility, a high conductibility copper alloy with an excellent surface state, such as high elongation and high platability which is required for workability is in demand, more strongly.

To deal with this, even though different copper alloys have been developed, there have been difficulties for preparing an excellent Cu—Cr base alloy as a high conductibility copper alloy, including a problem of preparing the Cu—Cr base alloy at a low cost, and in a high quality and high yield, easily.

Japanese Patent Laid Open Publication No. 2003-89832 (Hereafter, "a prior art 1") discloses molten metal of 0.02~0.4 wt % of Cr, 0.01~0.3 wt % of Zn, 0.005~1.0 wt % of at least one of Ti, Ni, Fe, Sn, Si, Mn, Co, Al, B, In and Ag, and a balance of Cu, prepared by subjecting an ingot from the molten metal to steps of hot rolling, solution treatment, cold rolling, ageing, cold rolling, annealing, and processing a raw material obtained with above steps to meet a required thickness, to obtain a product, in claim 4.

However, the copper alloy of the prior art 1 comprises, not Cr, but Zr, as a component, and has inadequate tensile strength even though conductivity thereof is high, and it is not clear how a physical property value on the elongation required for workability is reached while maintaining the tensile strength, and how hardness is reached while all of above physical property values are maintained, at all.

And, Japanese Patent Laid Open Publication No. 2001-181757 (Hereafter, "a prior art 2") discloses a copper alloy consisting of 0.2~0.35 wt % of Cr, 0.1~0.5 wt % of Sn, 0.1~0.5 wt % of Zn, 0.05~0.1 wt % of Si, at least one of Pb, Bi, Ca, Sr, Te, Se, and a rare earth element, and a balance of Cu, prepared by subjecting an ingot of molten metal of above composition to steps of heating to 880~980° C., hot rolling, cold rolling, and ageing at 360~470° C. before or after the cold rolling, to obtain a copper alloy having excellent blanking workability.

The prior arts secure characteristics of strength and conductibility by controlling solid solution and precipitateion of, mainly, a Cr or Cr—Si base compound by steps of hot rolling, cold rolling, solution treatment, and ageing, and so on.

In the prior art 2, if a copper alloy with around 0.3~0.4 wt % of Cr content is prepared without a high temperature solution treatment, a final rolled plate has many of a few tens μm of Stringer phases, or a few μm sized granular precipitates formed therein, affecting platablity by defects due to these or by difference of chemical properties of the precipitates and a Cu matrix.

And, Japanese Patent Laid Open Publication No. H7-54079 (Hereafter, "a prior art 3") discloses composition consisting of 0.01~0.2 wt % of Cr, 0.005~1 wt % of Zr, and as miscellaneous elements, 0.005~10 wt % of Ni, Sn, and Zn respectively, 0.005~5 wt % of Fe, Co, Te, and Nb respectively, 0.001~2 wt % of Be, Mg, Mo, W, Y, Ta, and rare earth elements respectively, 0.001~10 wt % of Mn and Al respectively, 0.001~5 wt % of Si, Ge, V, Cd, Hf, Sb, and Ga respectively, 0.001~3 wt % of Ag, and 0.001~1 wt % of B and P, respectively.

And, the prior art 3 intends to improve strength and electric conductivity by subjecting an ingot from molten metal of above composition to steps of hot rolling, solution treatment, ageing, and so on. The prior art 3 takes 35 kinds of miscellaneous elements as components.

That is, while families on the periodic table are 15 families in total including IA family~VIII family (8 families) and IB family~VIIA family (7 families), the prior art 3 takes elements belonging to 10 families excluding IA family (Alkali metal), HA family (Alkali earth family: four elements excluding Be and Mg), VIIA (Halogen family), VIA family (Oxygen family), and VA family (Nitrogen family) as components. However, table 1, illustrated Embodiments, not only discloses a Cu—Cr base, a Cu—Zr base, or a Cu—Cr—Zr base as components, wherein the Cu—Cr base alloys (Embodiments 1~5) are added by Ni, B, Fe, and P as the miscellaneous elements, the Cu—Zr base alloys (Embodiments 6~9) are added by Mg, Ag, and Be as the miscellaneous elements, and the Cu—Cr—Zr base alloys (Embodiments 10~22) are added by one kind (Embodiments 11~15, and 22), two kinds (Embodiments 16~17), or three kinds (Embodiments 18~21) as the miscellaneous elements, but also shows no information on the tensile strength at all and unclear information on the conductivity.

However, the prior art 3 has a problem in that, though the prior art 3 describes that as if all of the 25 kinds of elements are equivalent substances accompanying identical or similar effects by including the 25 kinds of elements as the miscellaneous materials, as made it clear in description of the embodiments, it is apparent that the technical constitution of the prior art 3 is actually limited to the embodiments.

Therefore, the prior art 3 has a limitation in having both the high conductibility and the high elongation at a time while improving or maintaining the tensile strength, and a problem in that the solution treatment accompanied in preparation of the copper alloy is a production cost increasing factor.

In the meantime, Korean Patent Application No. 10-2009-0004626 (Hereafter, "Prior Art 4") discloses an alloy consisting of 0.2~0.4 wt % of Cr, 0.05~0.4 wt % of Sn, 0.05~0.4 wt % of Zn, 0.01~0.05 wt % of Si, 0.003~0.02 wt % of P and Mn, and a balance of Cu.

In order to develop an alloy having excellent characteristics better than the strength and electric conductivity of the alloy of the prior art 4, Mg is added to the composition illustrated in embodiments of the prior art to invent a method for preparing a copper alloy having high strength, high workability, and high conductibility.

DISCLOSURE OF INVENTION

Technical Problem

To solve the problems, an object of the present invention is to provide a copper alloy in which Si used in a copper-stretching factory is employed to accelerate deoxidation, and which can be conveniently prepared even if elements, such as Cr, Sn or the like, are included to the alloy, and which has composition that can be molten and cast in the atmosphere, in a non-oxidizing atmosphere, or in a reducing atmosphere, so as to provide the copper alloy with high conductibility and appropriate workability without negatively affecting the tensile strength of the copper alloy, and in which a high-temperature solution treatment is eliminated in preparing the copper alloy, wherein the high-temperature solution treatment might otherwise be performed after completion of a hot-rolling for fully melting the Cr into a Cu matrix, thereby shortening a process and reducing a production cost; and a method for preparing the same.

Technical Solution

To achieve these objects and other advantages and in accordance with the purpose of the invention, as embodied and broadly described herein, a high conductibility copper alloy consists of, in 100 wt % composition, 0.2~0.4 wt % of Cr, 0.05~0.15 wt % of Sn, 0.05~0.15 wt % of Zn, 0.01~0.30 wt % of Mg, 0.03~0.07 wt % of Si, and a balance of Cu and inevitable impurities.

In above composition, the Cr is confined to be 0.2~0.4 wt %, because the Cr set to be below 0.2 wt % fails to meet the tensile strength, and the Cr set to exceed 0.4 wt % forms many Cr or Cr compounds in the Cu matrix, affecting the platability, negatively.

The Sn is confined to be 0.05~0.15 wt %, because the Sn set to be below 0.05 wt % fails to provide a Cr precipitateion suppression effect or a tensile strength improvement effect at a high temperature, and the Sn set to exceed 0.15 wt % causes a significant decline of the conductivity and poor stress resistant corrosivity.

The Zn is confined to be 0.05~0.15 wt %, because the Zn set to be below 0.05 wt % fails to provide a degasification effect or a heat resistant peeling improvement effect of plating in melting and casting, and the Zn set to exceed 0.15 wt % causes no more improvement in the above effects and acceleration in the decline rate of the conductivity.

The Si is confined to be 0.03~0.07 wt %, because the Si set to be below 0.03 wt % fails to provide adequate deoxidation in melting and casting and formation of Cr compound ($Cr_2Si$, and so on) in a step after heating of the ingot, failing to contribute to the strength, and to support formation of Cr base precipitates, and the Si set to exceed 0.07 wt % causes excessive formation of the Cr compound to make the conductivity poor due to large and many precipitates and increased solid solution Si.

The Mg is confined to be 0.01~0.30 wt %, because the Mg set to be below 0.01 wt % fails to contribute to improvement of the strength due to inadequate formation of Mg base precipitates, and the Mg set to exceed 0.3 wt % causes a problem of reduction of an Mg content as a casting time period goes to a later part of the casting the more due to strong oxidation and volatility of the Mg at the time of casting.

It is preferable that the Cr, Mg, and Si have a ratio of (Cr+Mg)/Si=2~10 in above composition.

And, the present invention describes a preparation method for obtaining desired strength and high conductivity on the material.

In another aspect of the present invention, a method for preparing a high tensile strength, and high conductibility copper alloy, includes the steps of obtaining an ingot by melting and casting to have above composition, and subjecting the ingot to heating to 900~1,000° C. and subsequent hot rolling, cold rolling, first ageing at 400~500° C. for 2~8 hours, cold rolling, and second ageing at 370~450° C. for 2~8 hours.

Though there is no particular restriction on heating the ingot in the present invention, it is not preferable that the hot rolling is performed at a temperature below 900° C. due to the excessive creation of Cr and Cr compound precipitates therein.

The high conductibility copper alloy of the present invention can be prepared with an ingot heating furnace or a hot rolling mill in a copper stretching factory having ordinary modern facility, without any fundamental problem.

The hot rolling takes around 10 minutes to be finished from the initiation to the final pass, and the obtained hot rolled stripe is wound in a shape of a coil after cooling, such as water cooling. It is preferable that a slow cooling, such as at the speed of 1° C./second, is avoided for preventing the precipitates from becoming coarse in a large amount. In succession to the water cooling, cold rolling is performed to have a uniform thickness, and followed by ageing.

Though an optimal age-hardening can be embodied in the first ageing of a low temperature-long time or a high temperature-short time ageing, the ageing at a temperature below 400° C. requires a long time period of the ageing which is not economical, and the ageing at a temperature exceeding 500° C. causes over-ageing, failing to embody the optimal age-hardening.

In the second ageing, the ageing below 370° C. requires a long time period of the ageing which is not economical, and the ageing at a temperature exceeding 450° C. causes over ageing, failing to embody the optimal age-hardening.

It is preferable that each of the first ageing and the second ageing is performed in a batch type annealing furnace.

The high tensile strength can be secured by forming Cr—Si base precipitates and Mg—Si base precipitates in the first ageing and the second ageing.

FIG. 1 illustrates a photograph of a scanning electron microscope of Cr—Si base precipitates and Mg—Si base precipitates, FIG. 2 illustrates an EDS analysis on Cr—Si base precipitates, and FIG. 3 illustrates an EDS analysis on Mg—Si base precipitates.

Advantageous Effects

Thus, the present invention can achieve a significant industrial effect of enabling to provide a copper alloy which has no surface defects, has elongation which is required for high conductibility and high workability of the copper alloy without negatively affecting the tensile strength that is a final alloy characteristic of the copper alloy by using Zn, Sn, Si, and Mg used in a copper stretching factory, and can dispense with the high temperature solution treatment after the hot rolling that is otherwise performed for adequate solid solution of the Cr in a Cu matrix in preparation of a copper alloy material, to shorten a production process, thereby permitting to a low production cost; and a preparation method thereof.

BEST MODE FOR CARRYING OUT THE INVENTION

Figure 1:
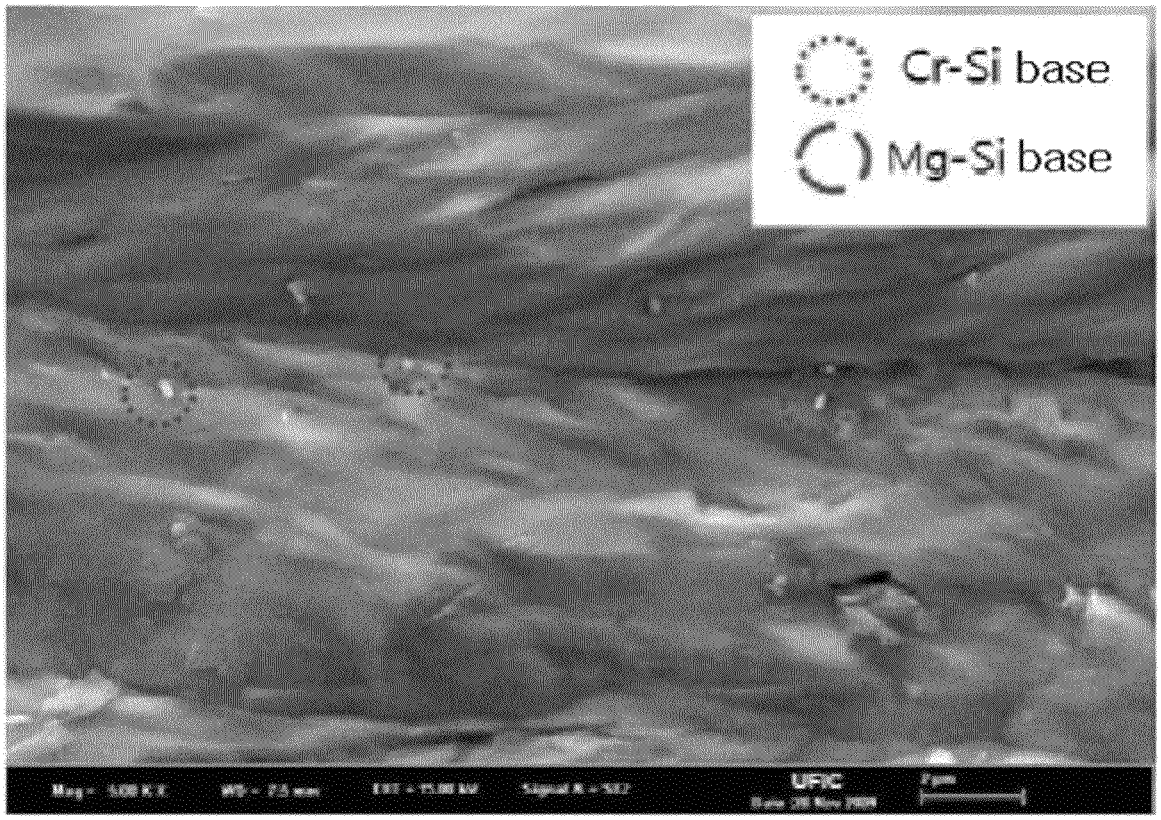
FIG. 1 illustrates a photograph of a scanning electron microscope of Cr—Si base precipitates and Mg—Si base precipitates.
Figure 2:
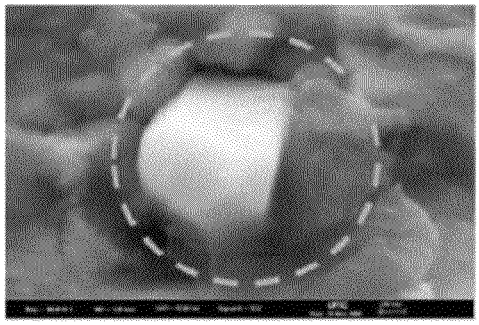
FIG. 2 illustrates an EDS analysis on Cr—Si base precipitates.
Figure 2:
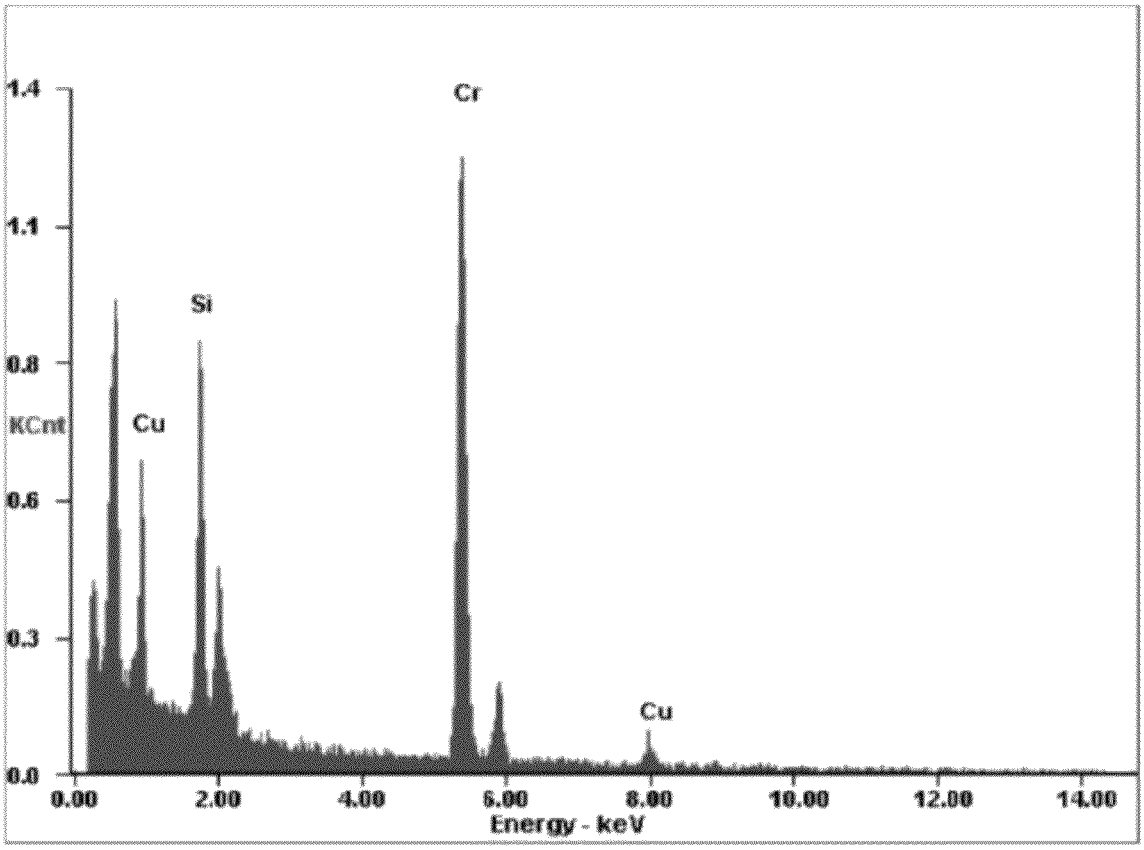
Figure 3:
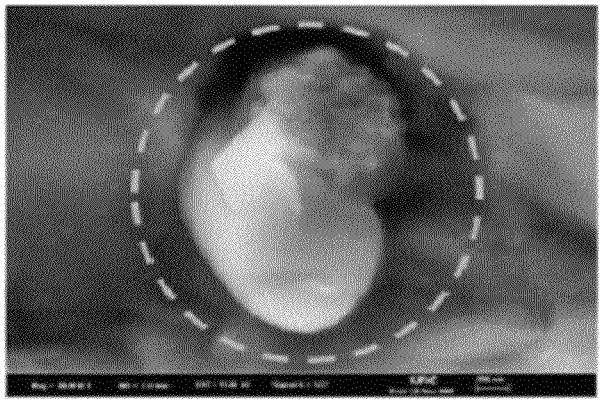
FIG. 3 illustrates an EDS analysis on Mg—Si base precipitates.
Figure 3:
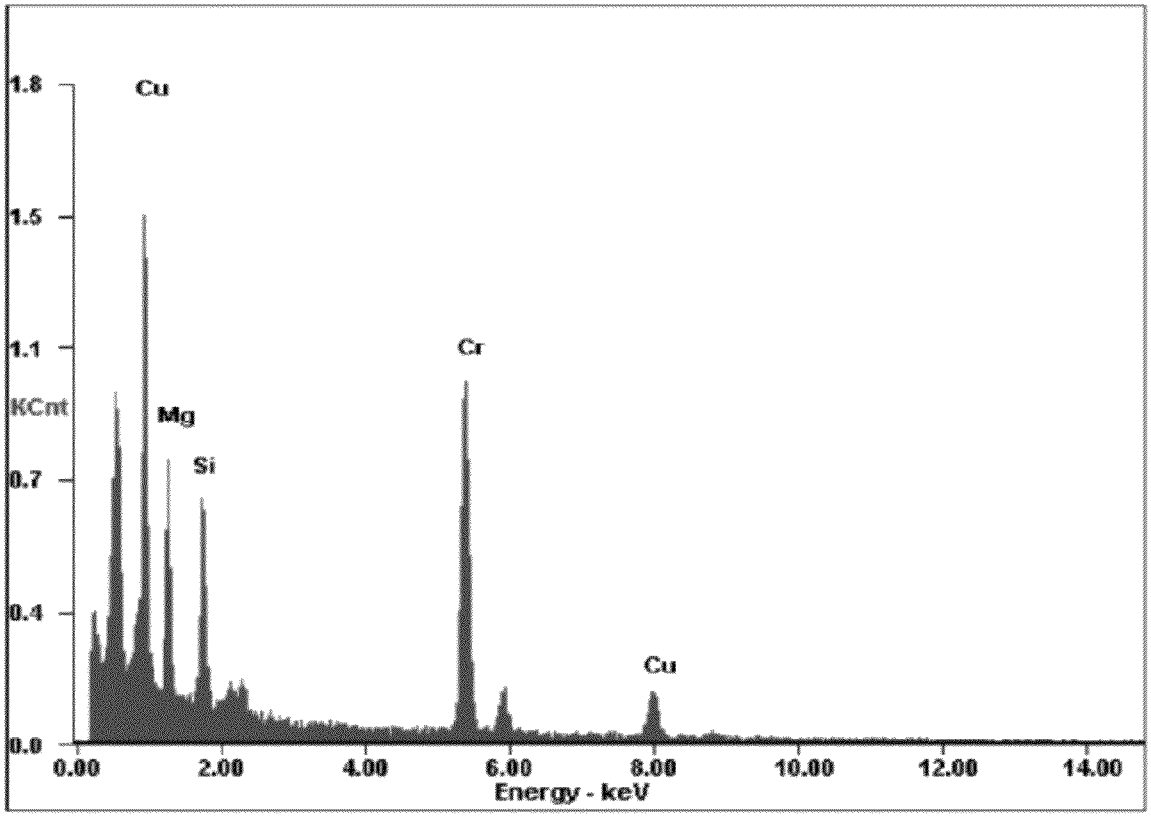

Reference will now be made in detail to the specific embodiments of the present invention, examples of which are illustrated in the accompanying drawings.

Alloy components according to composition shown on table 1 are melted in a high frequency melting furnace to obtain molten metal, and the molten metal is cast at a semi-continuous casting apparatus while coating the molten metal with charcoal or argon gas to produce an ingot with a 200 mm thickness, a 600 mm width, and a 7000 mm length.

And, for surface washing, acid cleaning and polishing is carried out after the selective ageing, and a corrective process is carried out with a tension leveler after the first heat treatment.

The preparation method in accordance with the preferred embodiment of the present invention is not limited to this, but may combine steps, according to requirements from clients, selected from the steps of hot rolling, cold rolling, ageing, surface cleaning (acid cleaning and polishing), tension annealing, tension beveling, and so on the same as normal practice made in a copper stretching shop for meeting different quality requirements from clients.

TABLE 1

| | | Composition(wt %) | | | | | | | | |
|---|---|---|---|---|---|---|---|---|---|---|
| Division | 6* | Cu | Cr | Sn | Zn | Si | Mg | P | Mn | 7* |
| 1* | 1 | Bal | 0.20 | 0.05 | 0.05 | 0.03 | 0.01 | | | |
| | 2 | Bal | 0.26 | 0.05 | 0.15 | 0.03 | 0.01 | | | ○ |
| | 3 | Bal | 0.29 | 0.08 | 0.33 | 0.04 | 0.01 | | | ○ |
| | 4 | Bal | 0.28 | 0.13 | 0.16 | 0.03 | 0.01 | | | ○ |
| | 5 | Bal | 0.26 | 0.05 | 0.14 | 0.02 | 0.06 | | | ○ |
| | 6 | Bal | 0.29 | 0.05 | 0.15 | 0.02 | 0.19 | | | ○ |
| | 7 | Bal | 0.28 | 0.05 | 0.15 | 0.03 | 0.31 | | | ○ |
| | 8 | Bal | 0.27 | 0.13 | 0.18 | 0.05 | 0.02 | | | ○ |
| | 9 | Bal | 0.28 | 0.13 | 0.15 | 0.03 | 0.1 | | | ○ |
| | 10 | Bal | 0.40 | 0.15 | 0.15 | 0.03 | 0.30 | | | ○ |
| 2* | 1 | Bal | 0.015 | 0.05 | 0.15 | 0.03 | 0.01 | | | ○ |
| | 2 | Bal | 0.5 | 0.05 | 0.18 | 0.04 | 0.01 | | | * |
| | 3 | Bal | 0.15 | 0.04 | 0.05 | 0.03 | 0.01 | | | ○ |
| | 4 | Bal | 0.2 | 0.3 | 0.05 | 0.04 | 0.01 | | | ○ |
| | 5 | Bal | 0.11 | 0.05 | 0.03 | 0.04 | 0.01 | | | ○ |
| | 6 | Bal | 0.18 | 0.08 | 0.3 | 0.04 | 0.01 | | | ○ |
| | 7 | Bal | 0.20 | 0.05 | 0.15 | 0.02 | 0.01 | | | ○ |
| | 8 | Bal | 0.20 | 0.05 | 0.30 | 0.1 | 0.01 | | | ○ |
| | 9 | Bal | 0.15 | 0.13 | 0.05 | 0.03 | 0.005 | | | ○ |
| | 10 | Bal | 0.20 | 0.10 | 0.10 | 0.04 | 0.4 | | | ○ |
| 3* | (1) | Bal | 0.28 | 0.07 | 0.06 | 0.011 | | 0.002 | 0.003 | ○ |
| | (2) | Bal | 0.23 | 0.23 | 0.15 | 0.029 | | 0.011 | 0.005 | ○ |
| | (3) | Bal | 0.21 | 0.38 | 0.37 | 0.049 | | 0.016 | 0.002 | ○ |
| | (4) | Bal | 0.31 | 0.03 | 0.11 | 0.012 | | 0.01 | 0.004 | ○ |
| | (10) | Bal | 0.15 | 0.11 | 0.14 | 0.015 | | 0.009 | 0.006 | ○ |
| | (11) | Bal | 0.25 | 0.035 | 0.28 | 0.018 | | 0.008 | 0.007 | ○ |
| | (12) | Bal | 0.29 | 0.1 | 0.038 | 0.032 | | 0.004 | 0.003 | ○ |
| | (13) | Bal | 0.3 | 0.13 | 0.022 | 0.007 | | 0.003 | 0.004 | ○ |
| 4* | (14) | Bal | 0.24 | | 0.15 | Ni 0.12 | | 0.05 | | |
| | (15) | Bal | 0.28 | 0.22 | 0.21 | | | | | |
| | (18) | Bal | 0.34 | | 0.10 | B 0.01 | Co 0.02 | | 0.14 | |
| 5* | (16) | Bal | 0.3 | | | Zr 0.05 | Cd 0.1 | | 0.2 | |
| | (17) | Bal | 0.3 | | 0.1 | Zr 0.05 | Ge 0.1 | | | |

1*: The present invention
2*: Comparative example
3*: Korea Patent Application No. 10-2009-0004626
4*: JP Patent Laid Open Publication No. 2003-89832
5*: JP Patent Laid Open Publication No. H7-54079
6*: Specimen Number
7*: Surface Defect After cutting off unstable cast portions from a top and a bottom of the ingot, the ingot is heated, and hot rolled at a hot rolling starting temperature of 960° C.

Then, a hot rolled stripe with a thickness of 12 mm at finishing of the hot rolling is cooled down to an ambient temperature by water spray quickly, and is wound into a coil. Then, in order to remove scales from a surface of the stripe, surfaces of both sides are machined by 1 mm respectively. Then, the stripe is cold rolled down to a thickness of 0.2 mm, aged at 475° C. for 6 hours, cold rolled down to a thickness of 0.2 mm again, and tension annealed at 425° C. for 4 hours to produce a rolled stripe.

Each of test pieces obtained by the aforementioned preparation method according to the above composition is cut and subjected to a surface defect inspection, a tensile strength (TS) test, an elongation (El) test, a Vickers hardness (Hv) test and an electric conductivity (EC) test to obtain a test result as shown in table 2.

Tensile strength and the elongation are measured in accordance with KS B0802, and the electric conductivity related to heat and electric conductibility is measured in accordance with KS D0240.

Surface defects are evaluated by cutting the test piece with a width of 30 mm and a length of 10 mm from a central portion both in a width direction and a length direction of a rolled stripe, and counting defects with a size longer than 1 mm at both sides thereof with naked eyes.

However, roll marks, dents, scratches, and so on which are basically not related to wholesomeness of the alloy itself are excluded from the counting.

TABLE 2

| Division | 1* | TS ($N/mm^2$) | El (%) | Hv (1 kg) | EC (% IACS) |
|---|---|---|---|---|---|
| The Present Invention | 1 | 475 | 10 | 160 | 90 |
| | 2 | 490 | 10 | 164 | 89 |
| | 3 | 510 | 12 | 166 | 85 |
| | 4 | 515 | 12 | 166 | 85 |
| | 5 | 530 | 10 | 173 | 89 |
| | 6 | 560 | 10 | 178 | 81 |
| | 7 | 570 | 10 | 185 | 78 |
| | 8 | 540 | 10 | 171 | 85 |
| | 9 | 560 | 10 | 173 | 80 |
| | 10 | 575 | 10 | 188 | 76 |
| Comparative Example | 1 | 470 | 10 | 160 | 75 |
| | 2 | 475 | 10 | 170 | 72 |
| | 3 | 460 | 10 | 155 | 70 |
| | 4 | 470 | 10 | 160 | 71 |
| | 5 | 455 | 10 | 157 | 70 |
| | 6 | 450 | 12 | 155 | 68 |
| | 7 | 465 | 10 | 165 | 72 |
| | 8 | 470 | 10 | 166 | 67 |
| | 9 | 465 | 10 | 164 | 67 |
| | 10 | 472 | 10 | 160 | 66 |
| Comparative Example Korea Patent Application No. 10-2009-0004626 | (1) | 510 | 11 | 155 | 81 |
| | (2) | 530 | 12 | 159 | 78 |
| | (3) | 540 | 12 | 164 | 73 |
| | (4) | 550 | 11 | 168 | 74 |
| | (10) | 430 | 11 | 133 | 83 |
| | (11) | 460 | 11 | 141 | 79 |
| | (12) | 540 | 12 | 163 | 73 |
| | (13) | 480 | 11 | 145 | 70 |
| JP Patent Laid Open Publication No. 2003-89832 | (14) | 630 | | | 74 |
| | (15) | 590 | | | 78 |
| | (18) | 610 | | | 79 |
| JP Patent Laid Open Publication No. H7-54079 | (16) | | | Over 140 | 65~75 |
| | (17) | | | 120~140 | Over 75 |

1*: Specimen No.

As can be known from table 1 and table 2, it is evaluated that the specimens 1 to 10 are excellent alloys showing good harmony of strength and electric conductivity while the strength and the electric conductivity is excellent in comparison to comparative examples 1~10, and embodiments Nos. (1)~(4), and (10)~(13) of the prior art Korea Patent No. 10-2009-0004626, and the surface defect takes place only at the comparative example 2 and the specimen No. (12) which is in the prior art.

Upon reviewing the properties, the comparative examples and the prior art specimen Nos. (13), (14), and (16) have tensile strength lower than a lowest tensile strength of 490N/$mm^2$ in the present invention, the prior art specimen Nos. (10), (13)~(16) have Vickers hardness lower than a lowest Vickers hardness 164 of the present invention, and the comparative example and the prior art specimen Nos. (11), (12), (15), and (16) have conductivity lower than a lowest conductivity 78% IACS of the present invention.

As can be known from above result, some of the properties of the comparative example and the prior arts are poorer than the present invention.

In the meantime, since all of the specimens of JP Patent Laid Open Publication No. 2003-89832 in the prior art are not the same with the composition of the present invention, the specimen numbers (14), (15), and (18) each of which includes P or Mn will be compared to the present invention.

It is shown that, though JP Patent Laid Open Publication No. 2003-89832 has electric conductivity poorer than the present invention, JP Patent Laid Open Publication No. 2003-89832 has strength more or less higher than the present invention. It appears that this is a characteristic come from addition of elements different from the elements of the present invention. And, JP Patent Laid Open Publication No. 2003-89832 fails to show data on hardness and elongation required for workability which the present invention shows.

Moreover, as described before, JP Patent Laid Open Publication No. 2003-89832 accompanies the solution treatment, causing an increase of production cost.

The specimen numbers (16) and (17) in JP Patent Laid Open Publication No. H7-54079 in the prior art show hardness and conductivity poorer than the present invention, and fail to show data on the tensile strength and the elongation.

Thus, since the copper alloy of the present invention has elongation required for high conductibility and high workability along with increased or maintained tensile strength, and does not require the high temperature solution treatment after finish of the hot rolling for making adequate solid solution of Cr into a Cu matrix in preparation of a copper alloy material, enabling to shorten a production process, the present invention can provide a copper alloy at a low cost; and a preparation method thereof.

MODES FOR CARRYING OUT THE INVENTION

As can be known from above result, some of the properties of the comparative example are poorer than the present invention.

In the meantime, since all of the specimens of JP Patent Laid Open Publication No. 2003-89832 in the prior art are not the same with the composition of the present invention, the specimen numbers (14), (15), and (18) each of which includes P or Mn will be compared to the present invention.

It is shown that, though JP Patent Laid Open Publication No. 2003-89832 has electric conductivity poorer than the present invention, JP Patent Laid Open Publication No. 2003-89832 has strength more or less higher than the present invention. It appears that this is a characteristic come from addition of elements different from the elements of the present invention. And, JP Patent Laid Open Publication No. 2003-89832 fails to show data on hardness and elongation required for workability which the present invention shows.

Moreover, as described before, JP Patent Laid Open Publication No. 2003-89832 accompanies the solution treatment, causing an increase of production cost.

The specimen numbers (16) and (17) in JP Patent Laid Open Publication No. H7-54079 in the prior art show hardness and conductivity poorer than the present invention, and fail to show data on the tensile strength and the elongation.

Thus, since the copper alloy of the present invention has elongation required for high conductibility and high workability along with increased or maintained tensile strength, and does not require the high temperature solution treatment after finish of the hot rolling for making adequate solid solution of Cr into a Cu matrix in preparation of a copper alloy material, enabling to shorten a production process, the present invention can provide a copper alloy at a low cost; and a preparation method thereof.

INDUSTRIAL APPLICABILITY

The present invention can be utilized widely as a copper alloy material having elongation required for high conductibility and high workability without negatively affecting the tensile strength for electric and electronic materials, such as a semiconductor lead frame material, or a terminal or connector material.

The invention claimed is:

1. A copper alloy with high tensile strength, high workability, and high conductibility, consisting of, in 100 wt % composition:

0.2~0.4 wt % of Cr,
0.05~0.15 wt % of Sn,
0.05~0.15 wt % of Zn,
0.01~0.30 wt % of Mg,
0.03~0.07 wt % of Si, and
a balance of Cu and inevitable impurities.

2. The copper alloy as claimed in claim 1, wherein the Cr, Mg, and Si have a ratio of (Cr+Mg)/Si=2~10.

3. The copper alloy as claimed in claim 1, wherein the high tensile strength means 490~570N/mm$^2$, the high conductibility means 78~89% IACS, and the elongation is in the range of 10~12%.

4. A method for preparing a copper alloy with a high tensile strength, high workability, and high conductibility, comprising the steps of:

obtaining molten metal consisting of, in 100 wt % composition:

0.2~0.4 wt % of Cr,
0.05~0.15 wt % of Sn,
0.05~0.15 wt % of Zn,
0.01~0.30 wt % of Mg,
0.03~0.07 wt % of Si, and
a balance of Cu and inevitable impurities;
obtaining an ingot from the molten metal;
heating the ingot to 900~1,000° C. to perform hot rolling;
cold rolling;
first aging at 400~500° C. for 2~8 hours;
cold rolling; and
second aging at 370~450° C. for 2~8 hours.

5. The method as claimed in claim 4, wherein the cold rolling is performed after the hot rolling and water cooling.

6. The method as claimed in claim 4, wherein each of the first ageing and the second ageing is performed in a batch annealing furnace.

7. The method as claimed in claim 4, wherein the high tensile strength is secured by forming Cr—Si base precipitates and Mg—Si base precipitates in the first aging and the second aging.

8. The method as claimed in claim 5, wherein the high tensile strength is secured by forming Cr—Si base precipitates and Mg—Si base precipitates in the first aging and the second aging.

9. The method as claimed in claim 6, wherein the high tensile strength is secured by forming Cr—Si base precipitates and Mg—Si base precipitates in the first aging and the second aging.

* * * * *

UNITED STATES PATENT AND TRADEMARK OFFICE

CERTIFICATE OF CORRECTION

PATENT NO. : 8,652,274 B2
APPLICATION NO. : 13/580954
DATED : February 18, 2014
INVENTOR(S) : Kim et al.

It is certified that error appears in the above-identified patent and that said Letters Patent is hereby corrected as shown below:

On the Title Page, in item (73), under "Assignee", in Column 1, Line 1, delete "Poonsgan Corporation," and insert -- Poongsan Corporation, --, therefor.

Signed and Sealed this
Sixteenth Day of September, 2014

Michelle K. Lee

Michelle K. Lee
*Deputy Director of the United States Patent and Trademark Office*